US009946218B2

(12) United States Patent
Meguro

(10) Patent No.: US 9,946,218 B2
(45) Date of Patent: Apr. 17, 2018

(54) CLEANING BLADE DISPOSED TO BE IN CONTACT WITH AN IMAGE CARRYING BELT HAVING AN ELASTIC LAYER AND AN IMAGE FORMING APPARATUS

(71) Applicant: KONICA MINOLTA, INC., Chiyoda-ku, Tokyo (JP)

(72) Inventor: Taichi Meguro, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/491,388

(22) Filed: Apr. 19, 2017

(65) Prior Publication Data

US 2017/0329274 A1 Nov. 16, 2017

(30) Foreign Application Priority Data

May 10, 2016 (JP) ..... 2016-094275

(51) Int. Cl.
*G03G 15/16* (2006.01)
*G03G 21/00* (2006.01)

(52) U.S. Cl.
CPC ..... *G03G 21/0017* (2013.01); *G03G 21/0029* (2013.01); *G03G 2221/0005* (2013.01)

(58) Field of Classification Search
CPC .. G03G 15/161; G03G 15/166; G03G 15/168; G03G 21/0011; G03G 21/0017
USPC ..... 399/101, 350
See application file for complete search history.

(56) References Cited

U.S. PATENT DOCUMENTS 7,610,008 B2 * 10/2009 Watanabe et al. . G03G 21/0017 399/350
9,170,556 B2 * 10/2015 Karashima et al. ..... G03G 21/0017
9,804,552 B2 * 10/2017 Tano et al. ..... G03G 21/0017

FOREIGN PATENT DOCUMENTS

JP 6-332350 A 12/1994
JP 2006-251362 A 9/2006
JP 2008-046365 A 2/2008

* cited by examiner

*Primary Examiner* — William J Royer
(74) *Attorney, Agent, or Firm* — Buchanan Ingersoll & Rooney PC

(57) ABSTRACT

Provided is a cleaning blade disposed to be in contact with an image carrying belt having an elastic layer for removing foreign material from a surface of the image carrying belt, including: a base; and an amorphous coating layer on the base, the coating layer including a contact portion disposed to be in contact with the image carrying belt, wherein the contact portion is curved to have a predetermined curvature with respect to a direction of a movement of the image carrying belt.

7 Claims, 5 Drawing Sheets

| CURVATURE RADIUS (μm) | 0 | 4 | 9 |
|---|---|---|---|
| VARIATION IN LOAD TORQUE | × | ○ | ○ |

| TONER REMOVAL | CURVATURE RADIUS (μm) | | | | | |
|---|---|---|---|---|---|---|
| CONTACT PRESSURE (N/m) | 4 | 9 | 14 | 20 | 22 | 28 |
| 30 | ○ | ○ | ○ | ○ | ○ | × |
| 25 | ○ | ○ | ○ | ○ | ○ | × |
| 20 | ○ | ○ | ○ | ○ | ○ | × |
| 15 | ○ | ○ | ○ | ○ | ○ | × |
| 10 | ○ | ○ | ○ | ○ | × | × |

CLEANING BLADE DISPOSED TO BE IN CONTACT WITH AN IMAGE CARRYING BELT HAVING AN ELASTIC LAYER AND AN IMAGE FORMING APPARATUS

The entire disclosure of Japanese Patent Application No. 2016-094275 filed on May 10, 2016 including description, claims, drawings, and abstract are incorporated herein by reference in its entirety.

BACKGROUND OF THE INVENTION

Field of the Invention

The present invention relates to a cleaning blade and an image forming apparatus.

Description of the Related Art

An image forming apparatus in related art includes a cleaning blade in contact with an intermediate transferring belt as an image carrying belt. The cleaning blade removes foreign material such as toner from the surface of the intermediate transferring belt to maintain a good image quality of an image to be formed.

The cleaning blade is generally made of rubber. When a rubber cleaning blade (with a low hardness) in related art is used for an intermediate transferring belt having an elastic layer with a low hardness, very high torque is produced, which curls the cleaning blade. To prevent this, there is provided a cleaning blade made of a stainless steel (SUS) with a high hardness that can reduce the torque and maintain its good cleaning ability.

When a high-hardness cleaning blade of SUS is used for a low-hardness intermediate transferring belt with an elastic layer, however, the cleaning blade is abraded by silica (an external additive to toner) on the surface of the intermediate transferring belt and wear debris is produced from the damaged areas of the cleaning blade of SUS having some structural defects. The wear debris is then pushed against the intermediate transferring belt by the cleaning blade to damage the intermediate transferring belt and deteriorate the image quality.

To prevent the production of the wear debris, there is an image forming apparatus including a cleaning blade (scraper) having an amorphous coating layer (See JP 2008-046365 A). The coating layer has a flat contact portion to reduce the pressure to an object to be cleaned (such as an intermediate transferring belt) and not to damage the object to be cleaned.

In the cleaning blade (scraper) disclosed in JP 2008-046365 A, however, the friction between the cleaning blade and the intermediate transferring belt becomes large in a high-temperature and high-humidity environment. Due to the large friction, the cleaning blade is pushed in the direction of the movement of the intermediate transferring belt, which increases the contact angle between the cleaning blade and the intermediate transferring belt. In a low-temperature and low-humidity environment, the friction between the cleaning blade and the intermediate transferring belt becomes small. Due to the small friction, the cleaning blade moves back in the opposite direction to the direction of the movement of the intermediate transferring belt, which reduces the contact angle between the cleaning blade and the intermediate transferring belt.

In a state where a contact portion of the cleaning blade is worn at a high-temperature and high-humidity (with a large contact angle), when an environment around the cleaning blade and the intermediate transferring belt changes from a high-temperature and high-humidity one to a low-temperature and low-humidity one, the friction between the cleaning blade and the intermediate transferring belt becomes smaller and the contact angle between the cleaning blade and the intermediate transferring belt also becomes smaller. As a result, the worn portion of the cleaning blade may come off the intermediate transferring belt (this phenomenon is called "a floating edge phenomenon" hereafter.).

The floating edge phenomenon allows toner to get in between the intermediate transferring belt and the worn portion of the cleaning blade and push up the cleaning blade, which causes the cleaning blade to fail to fully remove foreign material such as toner from the surface of the intermediate transferring belt and maintain its cleaning ability.

SUMMARY OF THE INVENTION

An object of the present invention is to provide a cleaning blade and an image forming apparatus that can prevent a floating edge phenomenon and maintain their good cleaning abilities.

To achieve the abovementioned object, according to an aspect, a cleaning blade disposed to be in contact with an image carrying belt having an elastic layer for removing foreign material from a surface of the image carrying belt, reflecting one aspect of the present invention comprises: a base; and an amorphous coating layer on the base, the coating layer including a contact portion disposed to be in contact with the image carrying belt, wherein the contact portion is curved to have a predetermined curvature with respect to a direction of a movement of the image carrying belt.

According to an aspect, in the cleaning blade, the contact portion preferably has a radius of curvature in a range of 4 μm to 20 μm.

According to an aspect, in the cleaning blade, the coating layer preferably has a hardness higher than the hardness of silica added to toner.

According to an aspect, in the cleaning blade, the base is preferably made of a metal.

According to an aspect, in the cleaning blade, the coating layer preferably has a Vickers hardness higher than 1000 HV but not higher than 3000 HV.

According to an aspect, in the cleaning blade, the coating layer is preferably made of a diamond-like carbon.

To achieve the abovementioned object, according to an aspect, an image forming apparatus reflecting one aspect of the present invention comprises the above-described cleaning blade.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an image forming apparatus according to an embodiment of the present invention will be described with reference to the drawings. However, the scope of the invention is not limited to the illustrated examples.

EMBODIMENTS

[1. Structure]

Figure 1:
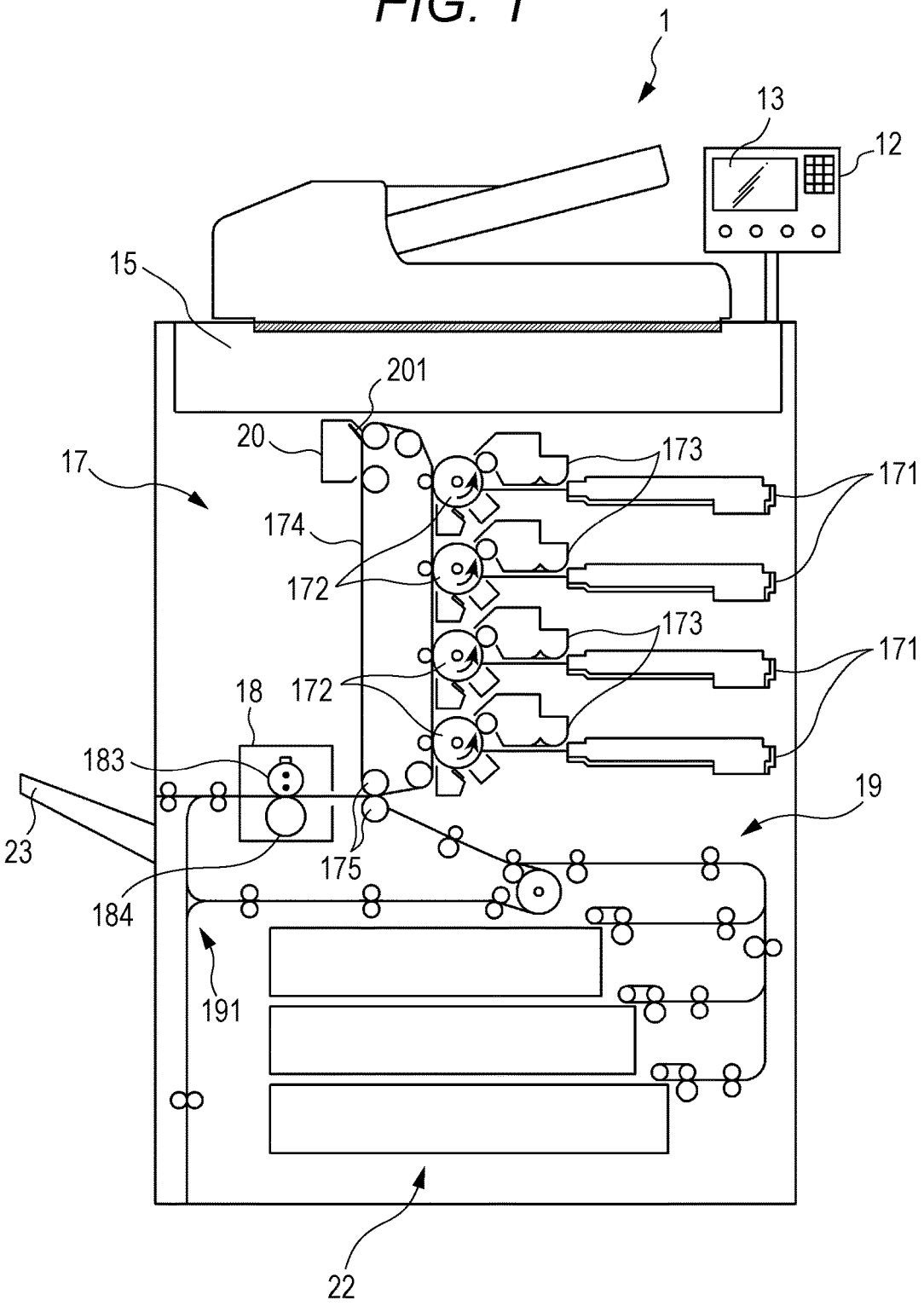
FIG. 1 is a schematic view of an image forming apparatus according to an embodiment of the present invention.
Figure 2:
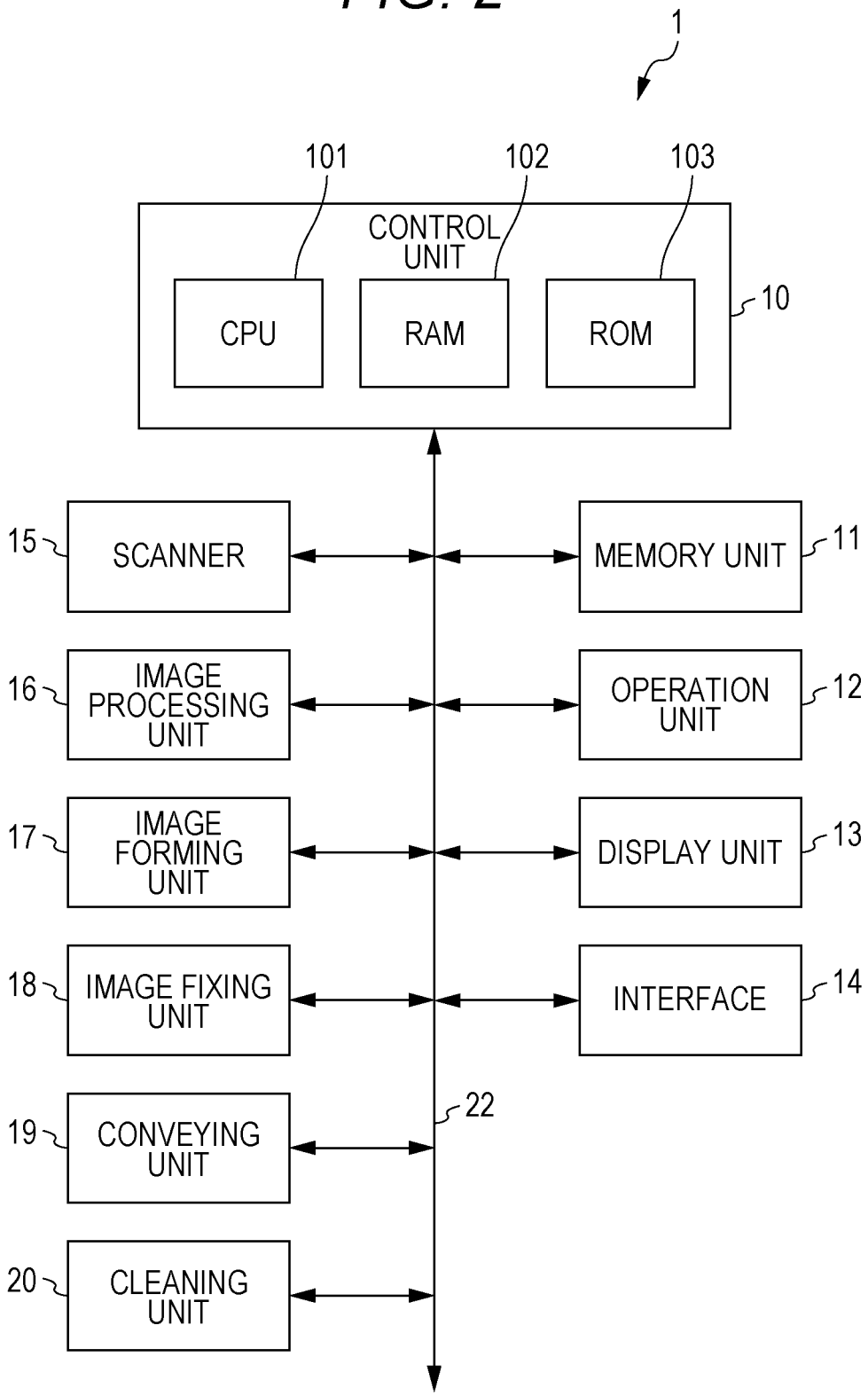
FIG. 2 is a block diagram illustrating the main functions of the image forming apparatus.

FIG. 1 is a schematic view of an image forming apparatus 1 according to an embodiment of the present invention. FIG. 2 is a block diagram illustrating the main functions of the image forming apparatus 1.

The image forming apparatus 1 includes a control unit 10 having a central processing unit (CPU) 101, a random access memory (RAM) 102, and a read only memory (ROM) 103; a memory unit 11; an operation unit 12; a display unit 13; an interface 14; a scanner 15; an image processing unit 16; an image forming unit 17; an image fixing unit 18; a conveying unit 19; and a cleaning unit 20. The control unit 10 is connected with the memory unit 11, the operation unit 12, the display unit 13, the interface 14, the scanner 15, the image processing unit 16, the image forming unit 17, the image fixing unit 18, the conveying unit 19, and the cleaning unit 20 via a bus 22.

The CPU 101 reads control programs from the ROM 103 or the memory unit 11 and executes them for data processing.

The RAM 102 provides work memory space for the CPU 101 and stores the temporary data.

The ROM 103 stores the control programs to be executed by the CPU 101 and other data. The ROM 103 may be replaced with a rewritable nonvolatile memory such as an electrically erasable programmable read only memory (EEPROM) or a flash memory.

The control unit 10 having these CPU 101, RAM 102, and ROM 103 comprehensively controls the individual units of the image forming apparatus 1 on a basis of the above control programs. For example, the control unit 10 instructs the image processing unit 16 to perform specific image processing on image data and instructs the memory unit 11 to store the data. The control unit 10 instructs the conveying unit 19 to convey a sheet of paper and instructs the image forming unit 17 to form an image on the paper sheet on a basis of the image data stored in the memory unit 11.

The memory unit 11 includes a memory, e.g. a semiconductor memory such as a dynamic random access memory (DRAM) or a hard disk drive (HDD), and stores the image data obtained through the scanner 15 or the interface 14. The image data may be stored in the RAM 102.

The operation unit 12 includes an input device such as a set of operation keys or a touch panel shown on the screen of the display unit 13, and converts the user's inputs to these devices into operation signals and sends the signals to the control unit 10.

The display unit 13 includes a display device such as a liquid crystal display (LCD), and displays information such as the status of the image forming apparatus 1 and the operation menu for operating a touch panel.

The interface 14 includes a serial interface, and exchanges data with an external computer or other image forming apparatus.

The scanner 15 reads an image on a paper sheet and generates three items of image data of three different colors: red (R), green (G), and blue (B) to store the image data in the memory unit 11.

The image processing unit 16 includes a rasterizing section, a color-converting section, a tone-correcting section, and a halftoning section, and performs image processing on the image data stored in the memory unit 11 to store the processed image data in the memory unit 11.

The image forming unit 17 forms an image on a paper sheet on a basis of the image data stored in memory unit 11. The image forming unit 17 includes four exposing sections 171, four photoconductor drums 172, and four developing sections 173 for four different colors: cyan (C), magenta (M), yellow (Y), and black (K). The image forming unit 17 also includes an intermediate transferring belt 174 and a pair of secondary transferring rollers 175.

The intermediate transferring belt 174 as an image carrying belt consists of a plurality of layers including a base layer and an elastic layer on the base layer. The elastic layer is made of an acrylonitrile-butadiene copolymer rubber (NBR) or a chloroprene rubber (CR).

For example, the base layer has a thickness in the range of approximately 50 μm to 100 μm. The elastic layer has a thickness in the range of approximately 100 μm to 500 μm to facilitate transferring an image to a recording medium having an uneven surface (such as a sheet of paper).

For example, the intermediate transferring belt 174 has a surface microhardness in the range of approximately 50 MPa to 500 MPa to maintain a good cleaning ability of the image forming apparatus 1. The reaction force from the cleaning blade has an element to deform the intermediate transferring belt 174, which causes the cleaning blade to fail to fully remove toner from a surface of the intermediate transferring belt 174. If the elastic layer is too elastic (the surface microhardness of the intermediate transferring belt 174 is too small), the cleaning blade fails to fully remove toner from the surface of the intermediate transferring belt 174.

To reduce its stickiness, the elastic layer may be coated with an oxide layer having a thickness in the range of approximately 5 μm to 20 μm or another coating layer having a thickness in the range of approximately 30 μm to 50 μm.

Each exposing section 171 includes a laser diode (LD) for emitting light. Each exposing section 171 irradiates the corresponding photoconductor drum 172, which is charged, with laser beams from its laser diode on a basis of image data so as to form an electrostatic latent image on the photoconductor drum 172. Each developing section 173 includes a developing roller, which is charged, and supplies color toner of one of the predetermined colors (C, M, Y, and K) to the corresponding photoconductor drum 172 with its developing roller so as to develop the electrostatic latent image formed on the photoconductor drum 172.

Four color images (C, M, Y, and K) individually formed on the respective four photoconductor drums 172 are sequentially transferred from the photoconductor drums 172 to the intermediate transferring belt 174. As a result, one color image composed of the four color elements (C, M, Y, and K) is formed on the intermediate transferring belt 174. The intermediate transferring belt 174 is an endless belt wound around a plurality of transferring rollers. The intermediate transferring belt 174 moves along the rotation of the transferring rollers.

The pair of secondary transferring rollers 175 transfers the color image from the intermediate transferring belt 174 to a paper sheet fed from a paper feed tray 22 or other external paper feeder. Specifically, a predetermined transferring voltage is applied to the secondary transferring rollers 175 holding a paper sheet and the intermediate transferring belt 174 on both sides so as to attract the toner forming the color image from the intermediate transferring belt 174 to the paper sheet.

The image fixing unit 18 applies heat and pressure to the paper sheet having the transferred toner image to fix the toner image on the paper sheet.

A fixing roller 183 includes a fixing lamp (or a fixing heater), which is a halogen lamp heater extending along its rotation axis. The halogen lamp heater is energized to generate heat under the control of the control unit 10. The fixing roller 183 is driven and rotated by a rotational driver such as a motor (not shown) under the control of the control unit 10.

A pressing roller 184 is pushed to the fixing roller 183 by an elastic member (not shown) to press a paper sheet together with the fixing roller 183 while rotating along the rotation of the fixing roller 183.

The pressing roller 184 may be driven and rotated by a rotational driver such as a motor (not shown) under the control of the control unit 10.

The fixing roller 183 and the pressing roller 184 cooperate to transfer a paper sheet or recording medium in the transferring direction while applying heat and pressure to the paper sheet therebetween. In this manner, the fixing roller 183 and the pressing roller 184 fuses the toner on the paper sheet to fix the toner image on the paper sheet. The fixing roller 183 in contact with a paper sheet has a temperature in the range of 180° C. to 200° C. The halogen lamp heater heats the fixing roller 183 up to this temperature.

As shown in FIG. 1, the conveying unit 19 includes a plurality of conveying rollers for holding a paper sheet on both sides and conveying the paper sheet in a predetermined route. The conveying unit 19 includes a flip-over mechanism 191. After the image fixing unit 18 fixes an image on a paper sheet, the flip-over mechanism 191 flips over the paper sheet to send it to the secondary transferring rollers 175. In the image forming apparatus 1, an image can be formed on both sides of a paper sheet through the flip-over operation by the flip-over mechanism 191 and the paper sheet is then ejected onto a paper output tray 23. When an image is formed on only one side of a paper sheet, the paper sheet does not go through the flip-over operation by the flip-over mechanism 191 before being ejected onto the paper output tray 23.

The cleaning unit 20 includes a cleaning blade 201 in contact with the intermediate transferring belt 174 for removing foreign material such as toner from the surface of the intermediate transferring belt 174.

Figures 3, 4, 5:
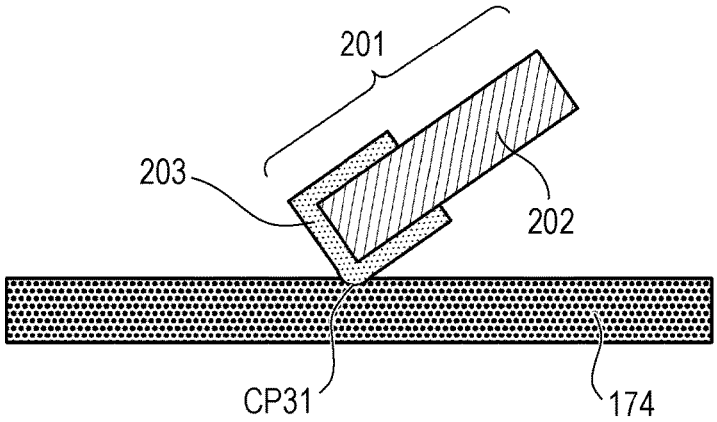
FIG. 3 is a schematic view of a cleaning blade.
FIG. 4 is an explanatory diagram illustrating the relationship between radii of curvature and the occurrence of a floating edge phenomenon.
FIG. 5 is an explanatory diagram illustrating the status of toner removal in relation to radii of curvature and contact pressures.

FIG. 3 is a schematic view of the cleaning blade 201. The cleaning blade 201 includes a base 202 made of a metal, and an amorphous coating layer 203 on the base 202. The coating layer 203 includes a contact portion CP31 in contact with the intermediate transferring belt 174. The contact portion CP31 has a predetermined curvature with respect to the direction of the movement of the intermediate transferring belt 174.

For example, the base 202 is a stainless steel plate having a thickness in the range of 60 μm to 200 μm so as to keep the good cleaning ability of the cleaning blade 201. If the base 202 is too thin, the cleaning blade 201 cannot have a preferable contact pressure and a preferable contact angle, which causes the cleaning blade 201 to fail to fully remove toner from the surface of the intermediate transferring belt 174. If the base 202 is too thick, the cleaning blade 201 cannot have a preferable followability in the direction of the ridge line, which causes the cleaning blade 201 to fail to fully remove toner from the surface of the intermediate transferring belt 174.

Preferably, the contact portion CP31 should have a radius of curvature of 4 μm or larger. As shown in FIG. 4 illustrating the relationship between radii of curvature and the occurrence of a floating edge phenomenon, if the contact portion CP31 has a radius of curvature smaller than 4 μm, a variation in load torque causes a floating edge phenomenon.

To determine whether a floating edge phenomenon occurs or not, the cleaning blade 201 should be subjected to friction in a plate wear test. In the test resulting in FIG. 4, a variation in load torque was measured under the conditions that a floating edge phenomenon occurs so as to determine whether a floating edge phenomenon occurs or not.

A variation in load torque is defined as a difference between a driving torque of the intermediate transferring belt 174 under a low-temperature and low-humidity environment (an LL environment: a temperature of 10° C. and a humidity of 20%) and that under a high-temperature and high-humidity environment (an HH environment: a temperature of 30° C. and a humidity of 80%). Variations in load torque were measured in relation to the different radii of curvature. The occurrence of a floating edge phenomenon was determined at the allowable value of a variation in load torque (0.02 N-m) as a threshold.

Preferably, the contact portion CP31 should have a radius of curvature of 20 μm or smaller. As shown in FIG. 5 illustrating the status of toner removal in relation to radii of curvature, if the contact portion CP31 has a radius of curvature larger than 20 μm, toner gets in between the contact portion CP31 and the intermediate transferring belt 174 and deforms the elastic layer of the intermediate transferring belt 174, which causes the cleaning blade 201 to fail to fully remove toner from the surface of the intermediate transferring belt 174.

In the test resulting in FIG. 5, an actual equipment was used. In the test, a toner image was directly formed on a belt and the belt was subjected to the cleaning operation by the cleaning unit 20. The evaluation was made on a basis of the amount of residual toner on the belt. As shown in FIG. 5, when the contact portion CP31 has a radius of curvature of 20 μm or lower, toner was fully removed at a contact pressure in the range of 10 N/m to 30 N/m.

Preferably, the coating layer 203 should have a Vickers hardness higher than 1000 HV but not higher than 3000 HV. Since silica, which is an external additive to toner, has a Vickers hardness of 1000 HV, the coating layer 203 having a Vickers hardness higher than 1000 HV improves the wear resistance of the cleaning blade 201 and extends its life. More preferably, the coating layer 203 should have a Vickers hardness of 1500 HV or higher.

Preferably, the coating layer 203 as an amorphous coating layer should be a diamond-like carbon (DLC) coating, which can achieve a necessary Vickers hardness and does not produce wear debris.

If the coating layer 203 has a Vickers hardness higher than 3000 HV, the increased internal stress will cause cracks in the coating layer 203. As a result, the coating layer 203 will fall off. For this reason, it is preferred that the coating layer 203 should have a Vickers hardness of 3000 HV or lower.

As described above, the cleaning blade 201 is provided in contact with the intermediate transferring belt 174 having the elastic layer for removing foreign material from the surface of the intermediate transferring belt 174. The cleaning blade 201 includes the base 202, and the amorphous coating layer 203 on the base 202. The coating layer 203 includes the contact portion CP31 in contact with the intermediate transferring belt 174. The contact portion CP31 has a predetermined curvature with respect to the direction of the movement of the intermediate transferring belt 174 so as to prevent a floating edge phenomenon and maintain the good cleaning ability of the cleaning blade 201

(Modification 1)

In the description of the above embodiment, the base 202 and the coating layer 203 of the cleaning blade 201 have been described in terms of their shapes and Vickers hardness. In the following, the positional relationship between the cleaning blade 201 and an opposed roller, which can also improve the cleaning ability of the cleaning blade 201, will be described.

Figure 6:
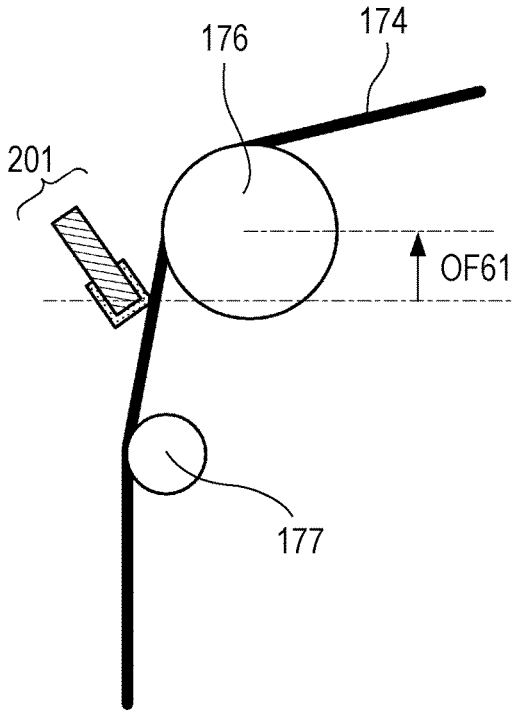
FIG. 6 is an explanatory diagram illustrating an example of a cleaning unit.

As shown in FIG. 6, in a first modification, an opposed roller 176 is offset from the cleaning blade 201 by a distance OF61 so that the opposed roller 176 is disposed slightly downstream of the position where the cleaning blade 201 is in contact with the intermediate transferring belt 174. The opposed roller 176 holds the intermediate transferring belt 174 at this position with the intermediate transferring belt 174 between the opposed roller 176 and the cleaning blade 201.

If the opposed roller 176 is not offset by the distance OF61, the cleaning blade 201 is pushed up by a slightly uneven surface of the opposed roller 176, which has not been leveled during manufacturing, or the dirt on the surface of the intermediate transferring belt 174. As a result, the cleaning blade 201 fails to remove toner near the slightly uneven areas of the surfaces.

For example, the distance OF61 is approximately 1 mm, which prevents the cleaning blade 201 from leaving some toner in those areas.

If the distance OF61 is too long, the intermediate transferring belt 174 will wave up to 300 μm and the cleaning blade 201 will fail to fully remove the toner in the hollow areas in the wavy surface of the intermediate transferring belt 174.

In the first modification, an auxiliary roller 177 may be disposed upstream of the contact position of the cleaning blade 201, if necessary, to prevent the cleaning blade 201 from leaving some toner due to the wavy surface of the intermediate transferring belt 174.

(Modification 2)

In the first modification, the auxiliary roller 177 is disposed upstream of the contact position of the cleaning blade 201 and the opposed roller 176 is disposed downstream of the contact position of the cleaning blade 201. Preferably, the cleaning blade 201 should be pushed by a spring-loaded mechanism as follows.

Figure 7:
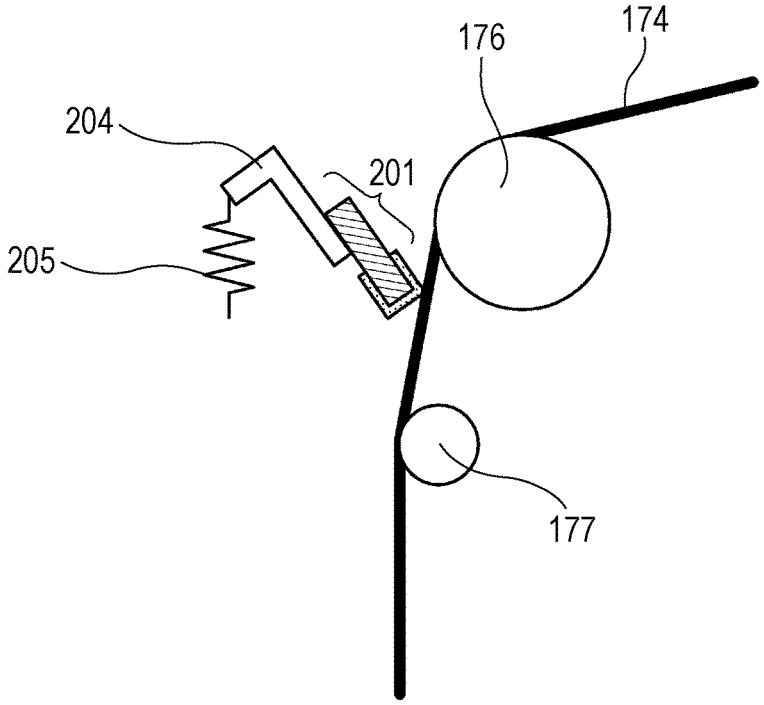
FIG. 7 is an explanatory diagram illustrating another example of the cleaning unit.

This is because the hardness of the intermediate transferring belt 174 changes depending on temperature and the contact pressure of the cleaning blade 201 changes with the varied hardness. As shown in FIG. 7, in a second modification, the cleaning blade 201 is connected with a member 204 having a spring 205 and subjected to the spring load from the spring 205 via the member 204. Due to this mechanism, the cleaning blade 201 can maintain an appropriate contact pressure independent of variation in temperature.

The spring 205 is not limited to a tensile coil spring shown in FIG. 7 and may be any other spring such as a compressive coil spring.

(Modification 3)

There may be provided a mechanism for preventing the toner removed by the cleaning blade 201 from adhering to the intermediate transferring belt 174 again.

Figure 8:
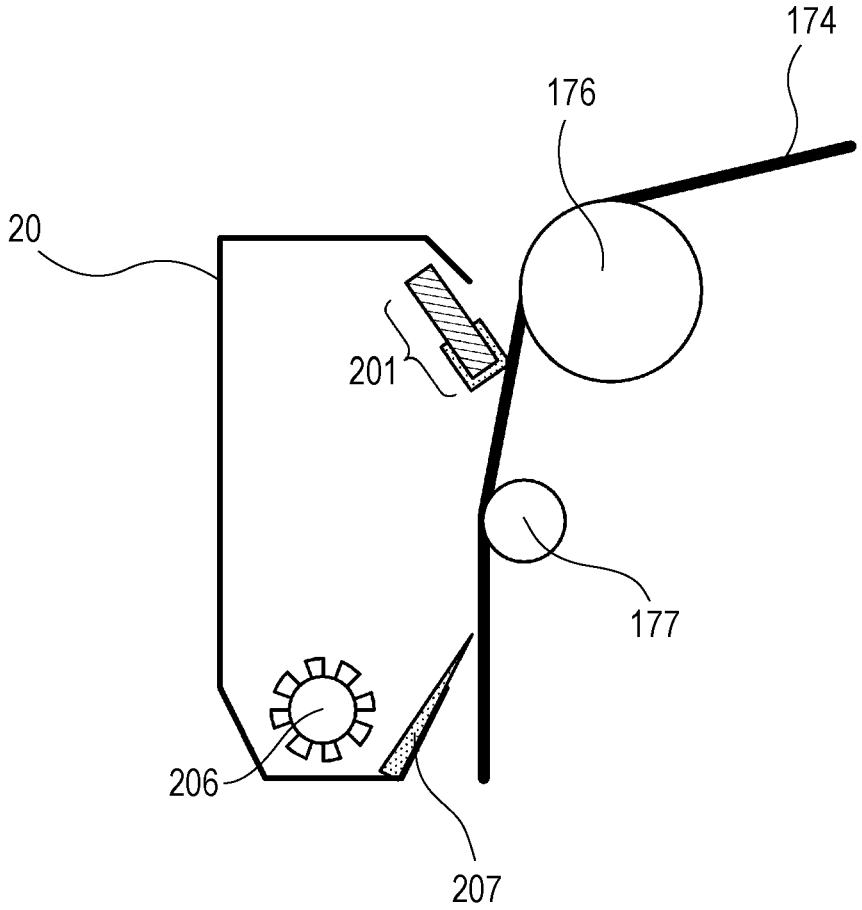
FIG. 8 is an explanatory diagram illustrating yet another example of the cleaning unit.

As shown in FIG. 8, in a third modification, the cleaning unit 20 includes an exhaust fan 206. The exhaust fan 206 collects the fallen toner, which has been removed by the cleaning blade 201, to prevent the toner from adhering to the intermediate transferring belt 174 again.

As shown in FIG. 8, the cleaning unit 20 may include a partition 207 so that the toner off from the cleaning blade 201 falls along the partition 207 to be surely collected by the exhaust fan 206. The partition 207 may be covered with a urethane sheet at the upper end to surely prevent toner from adhering to the intermediate transferring belt 174 again.

In the above embodiments, the fixing roller 183 and the pressing roller 184 cooperate to hold a paper sheet on both sides in the image fixing unit 18. Alternatively, the image fixing unit 18 may include a heating roller, and a fixing belt stretched between the heating roller and the fixing roller 183. The fixing roller 183 and the pressing roller 184 may hold a paper sheet via the fixing belt for transferring.

In the above embodiments, the image forming apparatus 1 includes the four individual image forming mechanisms for the four different colors: Y, M, C, and K to form a color image on a paper sheet. The image forming apparatus 1 is not limited to this and may form a monochrome image, for example.

In the above embodiments, a sheet of paper is used as a recording medium; however, a recording medium is not limited to this and may be any other sheet on which a toner image can be formed and fixed, such as a sheet of nonwoven cloth, a sheet of plastic, or a sheet of leather.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A cleaning blade disposed to be in contact with an image carrying belt having an elastic layer for removing foreign material from a surface of the image carrying belt, comprising:

a base; and an amorphous coating layer on the base, the coating layer including a contact portion disposed to be in contact with the image carrying belt, wherein the contact portion is curved to have a predetermined curvature with respect to a direction of a movement of the image carrying belt.

2. The cleaning blade according to claim 1, wherein the contact portion has a radius of curvature in a range of 4 μm to 20 μm.

3. The cleaning blade according to claim 1, wherein the coating layer has a hardness higher than the hardness of silica added to toner.

4. The cleaning blade according to claim 1, wherein the base is made of a metal.

5. The cleaning blade according to claim 1, wherein the coating layer has a Vickers hardness higher than 1000 HV but not higher than 3000 HV.

6. The cleaning blade according to claim 1, wherein the coating layer is made of a diamond-like carbon.

7. An image forming apparatus comprising the cleaning blade according to claim 1.

* * * * *